US006431834B1

(12) United States Patent
Lackey et al.

(10) Patent No.: US 6,431,834 B1
(45) Date of Patent: Aug. 13, 2002

(54) MULTI-CONNECTION, STABLE FAN BLADE ATTACHMENT MOUNT

(75) Inventors: Robert W. Lackey, Hickory; Roy Nicholson, Boone, both of NC (US)

(73) Assignee: Prime Home Impressions, LLC, Coppell, TX (US)

( * ) Notice: Subject to any disclaimer, the term of this patent is extended or adjusted under 35 U.S.C. 154(b) by 0 days.

(21) Appl. No.: 09/651,020

(22) Filed: Aug. 30, 2000

(51) Int. Cl.[7] ..... F04D 29/36

(52) U.S. Cl. ..... 416/205; 416/5; 416/204 R; 416/210 R; 416/246; 403/3; 403/4

(58) Field of Search ..... 416/5, 210 R, 416/204 R, 205, 207, 246; 403/3, 4

(56) References Cited

U.S. PATENT DOCUMENTS

| | | | | |
|---|---|---|---|---|
| 238,846 A | | 3/1881 | Brown | |
| 256,614 A | | 4/1882 | Babbitt | |
| 263,498 A | | 8/1882 | Flannery | |
| 270,563 A | | 1/1883 | Deuther | |
| 271,134 A | | 1/1883 | Scanlan et al. | |
| 587,245 A | | 7/1897 | Stellner | |
| 888,635 A | | 5/1908 | Morris | |
| 1,031,415 A | | 7/1912 | Boutwell | |
| 1,382,836 A | | 6/1921 | Juelson | |
| 1,427,391 A | | 8/1922 | Johns | |
| 1,583,864 A | | 5/1926 | Tucker | |
| 1,604,757 A | | 10/1926 | Reed | |
| 1,799,519 A | | 4/1931 | Laube | |
| 2,950,686 A | | 8/1960 | Ledel et al. | |
| 3,131,956 A | | 5/1964 | Bailey | |
| 3,300,123 A | | 1/1967 | Freyholdt et al. | |
| 4,035,093 A | | 7/1977 | Redshaw | |
| 4,139,330 A | | 2/1979 | Neal | |
| D265,681 S | * | 8/1982 | Kan | 416/5 |
| 4,456,382 A | | 6/1984 | Mahler, II | |
| 4,511,310 A | | 4/1985 | Pearce | |
| 4,634,341 A | | 1/1987 | Monroe | |
| 4,640,668 A | * | 2/1987 | Yang | 416/5 |
| 4,754,857 A | * | 7/1988 | Urban | 403/4 |
| 4,936,751 A | | 6/1990 | Marshall | |
| 5,080,388 A | * | 1/1992 | Berry et al. | 403/4 |
| 5,174,675 A | * | 12/1992 | Martin | 403/4 |
| 5,873,701 A | * | 2/1999 | Shiu | 416/205 |

FOREIGN PATENT DOCUMENTS

| | | | | |
|---|---|---|---|---|
| GB | 2172936 A | * | 10/1986 | 416/5 |
| JP | 62-218694 A | * | 9/1987 | 416/5 |

* cited by examiner

*Primary Examiner*—Christopher Verdier
(74) *Attorney, Agent, or Firm*—John B. Hardaway, III; Nexsen Preuet Jacobs & Pollard, LLC

(57) ABSTRACT

An apparatus for mounting ceiling fan blades onto ceiling fan blade mounting ring rotor extension. The fan blade attachment mount is can be adapted to fit a multitude of fan rotors configurations. The appearance of the mounting and support members is aesthetically pleasing and the mounting apparatus provides a stable connection between a plurality of ceiling fan blade assemblies and a variety rotor extension mounting surfaces of a ceiling fan.

6 Claims, 6 Drawing Sheets

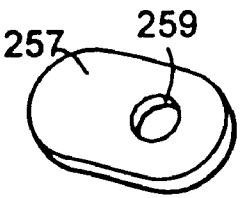
FIG. 6A
FIG. 6B
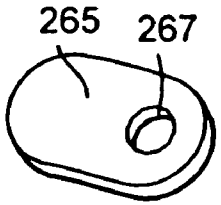
FIG. 6C
FIG. 6D
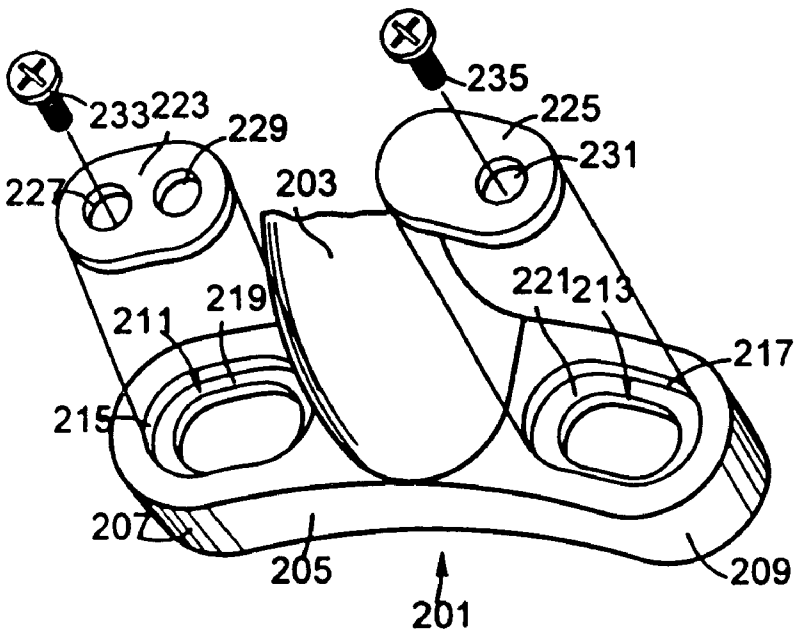
FIG. 5

MULTI-CONNECTION, STABLE FAN BLADE ATTACHMENT MOUNT

BACKGROUND OF THE INVENTION

Field of the Invention

The present invention relates generally to an apparatus for mounting a ceiling fan blade onto a ceiling fan motor mounting ring, and more particularly to an apparatus for mounting a ceiling fan blade that can fit several fan motor mounting ring configurations.

Ceiling fan blades are typically attached to a motor rotor or an extension thereof, such as a mounting ring. The fan blades are attached through an arm or bar attached to both the blade and the mounting ring.

In addition, it has been found that ceiling fan blades are frequently changed. In some cases this is to modify the appearance of a ceiling fan by detaching old blades and subsequently attaching new ones of a different color or style. In other cases, the attachment mount which connects a fan blade to a fan motor mounting ring is damaged either through stresses caused by repeated start-ups of the rotor, or by the fan blade coming in contact with another object and causing bending or breaking of the fan blade mount. In either case, or for what ever reason, there exists a need for the replacement of ceiling fan attachment mounts, and in particular mounts that provide optimal stability and safety.

Replacing ceiling fan blade attachment mounts presents some difficulties, however. First, to replace a broken fan blade mount in the past, it was necessary to contact the manufacturer or distributor of the fan to order replacement parts. Unfortunately though, the manufacturer may no longer be in business or as is more often the case, is not manufacturing that particular model such that new fan blade attachment mounts are no longer compatible with an older model. Plus, even if new attachment mounts are available, it may take several weeks to receive them. Thus, an independent source of fan blade attachment mounts is needed.

Moreover, ceiling fans come in a wide variety of styles and from a large number of manufacturers. As such, various fan blade mounting hole configurations exist, depending on a fan's particular manufacturer and model number. In particular, the circumferential positioning of mounting screw holes around their respective blade mounting rings depends on the number of required blades, the diameter of the mounting ring, the particular mounting design of each type of fan, and the bolt hole pattern in the ring.

As a result, various fan blade mounting rings, which receive blade attachment mountings and thus provide a surface for the connection of attachment mountings (and their blades) to fan rotors, differ with respect to mounting fastener hole positioning. For example, mounting rings that accommodate five blades have different relative circumferential mounting bolt hole positioning than mounting rings that accommodate only four blades. Even between fans having the same number of blades, one manufacturer of a four-blade fan may design a mounting surface such that the spacing and relative positioning of mounting fastener holes differs from that of another manufacturer's four-blade fan. This case and others like it where mounting hole positioning differs, have traditionally required at least two fan blade attachment mounts, one for four blade fans, the other for five blade fans. The alternative is a spacer.

Such cases required the production and marketing of separate attachment mountings to ensure optimal stability and safety during fan operation. Each of these unfunctional blade attachment mounts, however, accommodate only one of the many unique fastener hole patterns found on the various ceiling fan attachment mount receiving surfaces.

DESCRIPTION OF RELATED ART INCLUDING INFORMATION

Disclosed Under 37 CFR 1.97 and 37 CFR 1.98

Several attachment mounts exist for attaching ceiling fan blades onto the mounting ring of a ceiling fan. U.S. Pat. No. 4,936,751, teaches a universal fan blade mounting assembly that attaches to a ceiling fan mounting ring to accommodate a number of fan motor housings. The patent discloses a slot, rather than a hole for receiving one of the two mounting screws typically used for fan blade mounting attachments. The screw in the slot locates the mount but the stresses are placed on the other screw. As the blade attachment undergoes significant centrifugal forces, the slot attachment tends to loosen. The mounting not only then is susceptible to significant vibration, but the second un-slotted screw hole attachment position receives additional stress, and becomes more likely to loosen.

U.S. Pat. No. 4,511,310, teaches an attachment ring for reducing vibrations and for attaching the ceiling fan bracket to the ceiling fan motor. The attachment ring has no apparent ability to use the device to fit motor mounting rings having variable screw hole positionings.

Design Patent No. D271,134 and U.S. Design Patent No. D271,134, likewise teach fan blade attachment mounts, but none of these allow multi-fan type use.

Clearly, there exists room for improvement in the art.

SUMMARY OF THE INVENTION

It is an object of this invention to provide an apparatus for attaching a fan blade that allows attachment of ceiling fan blades to the mounting surface of several types of ceiling fan blade mounting rings.

It is an additional object of this invention to provide a more stable, durable and thus safer fan blade attachment mount.

It is an additional object of this invention to provide an apparatus for attaching a fan blade that alleviates undue stresses imposed thereon.

It is an additional object of this invention to provide an apparatus for attaching a fan blade that is simple in design, light-weight, sturdy, and does not look like an after-market universal adaptor.

It is yet a further and more particular object of this invention to provide an apparatus for attaching a fan blade that is easy-to-install.

These and other objects of the invention are accomplished by a fan blade attachment mount for supporting and connecting a ceiling fan blade to various fan blade mounting rings having distinct mounting surfaces and receiving points, comprising an elongated support member having a proximal end adapted to connect to the ceiling fan mounting ring, and a distal end adapted to connect to a fan blade; a first flange portion connected to the proximal end and having at least one hole; a second flange portion connected to the proximal end and having one or more holes, each adapted to receive a fastening means; wherein said attachment mounting is adapted to being fastened to a plurality of mounting rings having varying receiving point configurations, according to which of the one or more holes in the second flange portion, operably receives the fastening means for connection to the mounting surface. Thus, the objects of the invention are accomplished by the fan blade mounting as described herein.

BRIEF DESCRIPTION OF THE DRAWINGS

The features and advantages of the present invention will become apparent from a reading of the following detailed description, given with reference to the various figures of drawings, in which:

FIG. 5 is a bottom, assembly perspective view of the proximal end of an attachment mount having channels which receive two insertable plates; and FIGS. 6*a–d* are perspective views of plates having variously positioned holes to receive mounting screws for fastening of the attachment mounting in FIG. 5 to a fan rotor extension.

DETAILED DESCRIPTION

Figure 1:
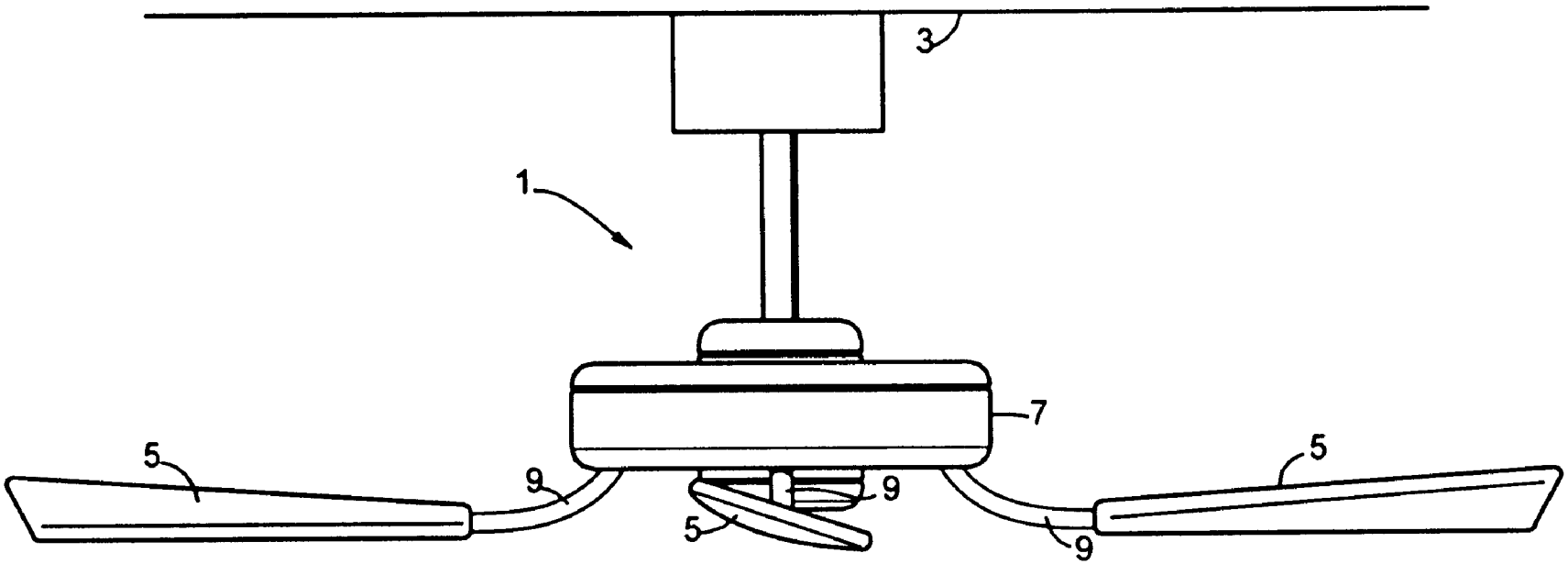
FIG. 1 s a side perspective view of a ceiling fan having a blade connected to a ring mounting by an attachment mount in accordance with this invention.

In accordance with the present invention, therefore, FIG. 1 shows a ceiling fan 1 attached to a ceiling 3. Ceiling fan 1 has blades 5 that are connected to the ceiling motor's rotor extension. (Such as a mounting ring—not shown because it is encased by housing 7) by attachment mounts 9. These attachment mounts 9 lend increased stability, durability, and strength while at the same time providing attachment of ceiling fan blades to the mounting surface of several types of ceiling fan blade mounting rings. As such, fan blade attachment mount 9 is adapted to support and connect ceiling fan blade 5 to various fan blade mounting rings (not shown) and other rotor extensions, each having distinct mounting surfaces and distinct receiving point configurations (both not shown).

Figure 2:
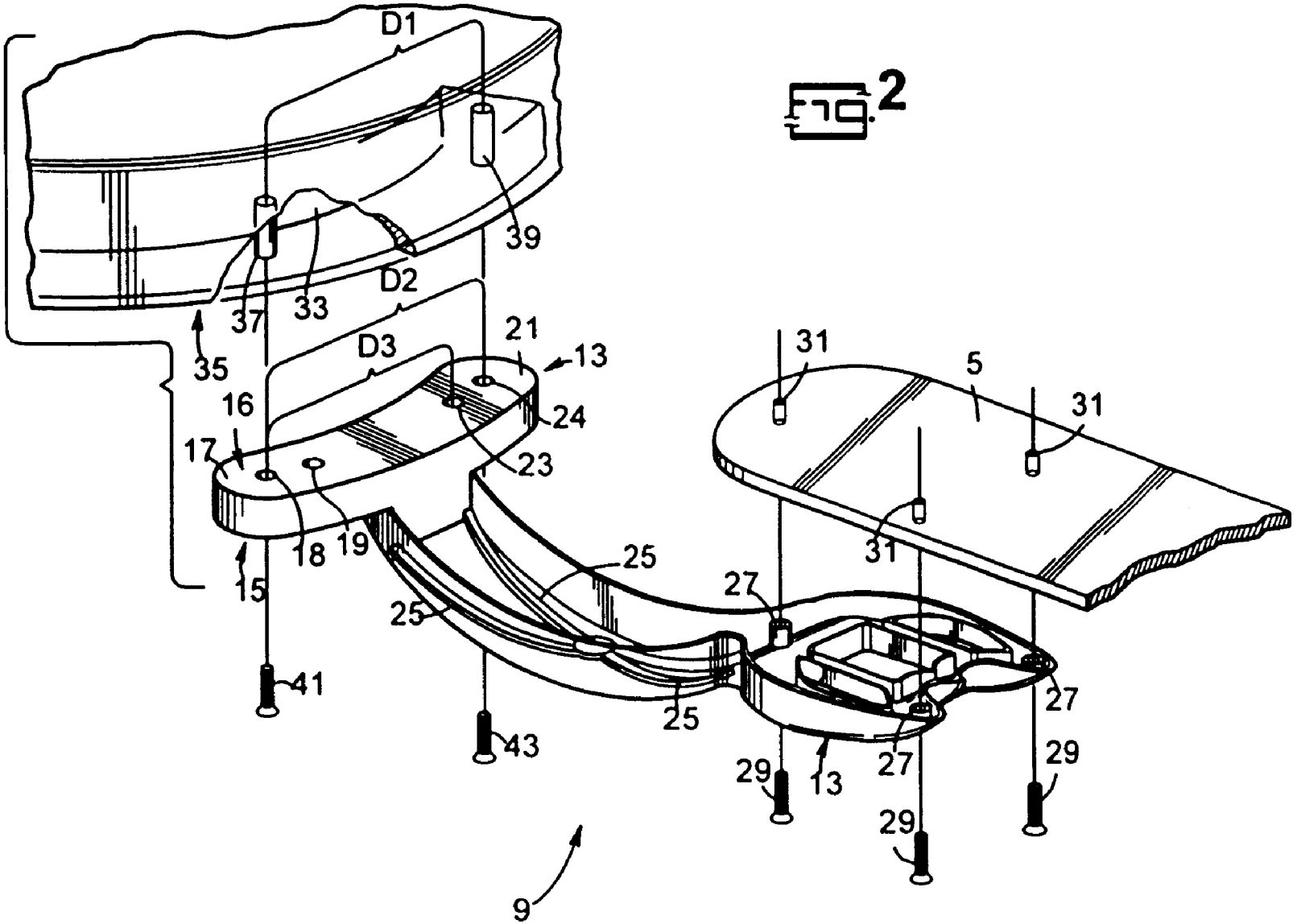
FIG. 2 is a top assembly perspective view of a ceiling fan blade attached to a rotor mounting ring via an attachment mount in accordance with the present invention.

FIG. 2 illustrates a preferred embodiment of the present invention. Fan blade attachment mount 9 includes an elongated support member 11 having relative to the blade, a proximal end 15 and a distal end 13. The elongated support member 11 is reinforced by web segments 25 that are integral with the rigid, and preferably brass or other metal structure, of support member 11 and base 17. Distal end 13 is adapted to attach to a fan blade 5 at attachment holes 27. Screws 29 thread through holes 27 and into attachment threads 31 of blade 5 thus to attach the distal end 13 of the attachment mount 9 to fan blade 5.

Proximal end 15 includes a kidney/disc-shaped base 16. One end of base 16 acts as a first flange portion 17. It has two circular holes 18, 19. The other end of base 16 is a second flange portion 21. It also has a pair of concentric holes 23, 24. The proximal end 15 is fastened to the mounting surface 33 of a rotor mounting ring 35 by fasteners into threaded mounting holes 37, 39. Fasteners such as screws 41, 43 attach each of the flange portions 17, 21 to mounting surface 33 at holes 37, 39 respectively. It should be noted that mounting holes 37, 39 vary in their relative positioning to one another as determined by differences in mounting hole patterns of varying ceiling fan mounting rings. As seen in FIG. 2, screw 41 fits through hole 18 and into mounting hole 37. Likewise, fastening screw 43 fits into hole 24 and into mounting hole 39. This is because the distance between hole 18 and hole 24 is equidistant to the distance between mounting hole 37 and mounting hole 39. In other words, mounting screw holes 37, 39 are separated by a distance D1, and holes 18, 24 are separated by a distance D2. As seen in FIG. 2, distance D1 is equal to the distance D2. It should be noted, therefore, that if the distance between receiving points, and in particular mounting screw holes 37,39 on mounting ring 35, were shorter, i.e. if this distance was equal to the distance D3 between holes 18, 23, then holes 18, 23 would be used for fastening attachment mounting 9 to the existing mounting ring instead.

Figure 3:
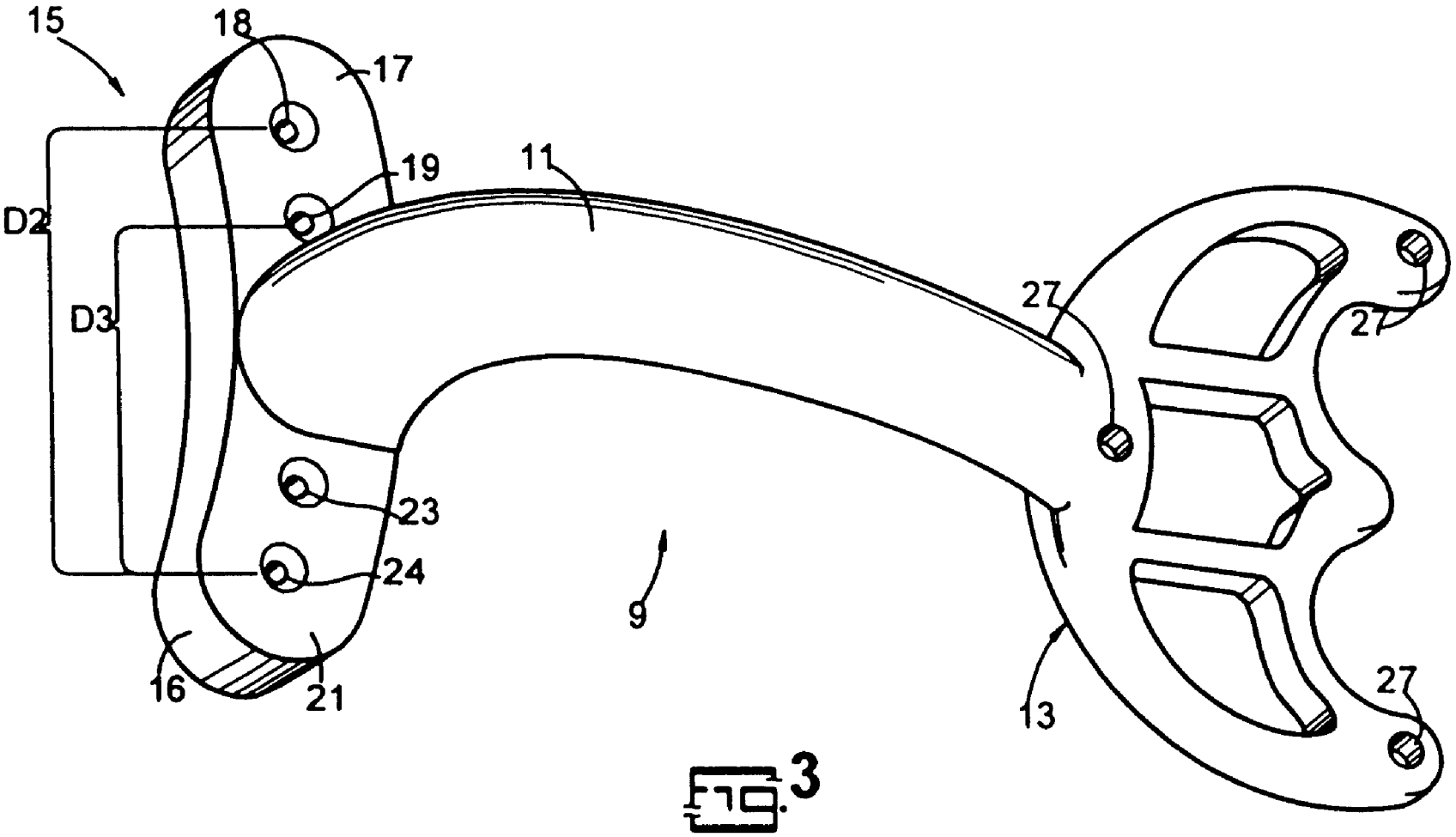
FIG. 3 is a bottom perspective view of the attachment mount in FIG. 2.

Thus, the attachment mount of the embodiment seen in FIG. 2 allows attachment of fan blades to at least two types of ceiling fans having varying mounting surfaces and receiving points. As seen in FIG. 3, holes 18, 19, 23, 24 allow mounting on two types of ceiling fans, those having mounting screw holes spaced at a distance equal to distance D2, and those having mounting screw holes spaced at a distance equal to distance D3.

Figure 4A:
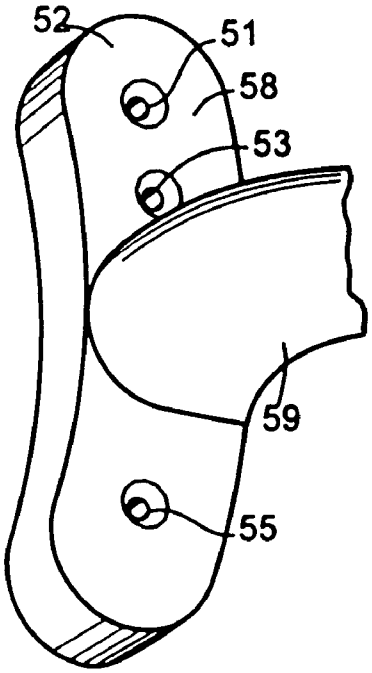
FIGS. 4*a–d* are bottom perspective cutaway views of the proximal ends of various embodiments of attachment mounts in accordance with this invention.

Similarly, alternate embodiments such as those shown in FIGS. 4*a–d* allow attachment of fan blades to a diverse assortment of ceiling fans, each having different mounting screw hole configurations. As seen in FIG. 4*a*, either of holes 51 or 53 may be used with hole 55 to fasten attachment mount 59 to two possible mounting surfaces having different mounting screw hole positions.

Figure 4B:
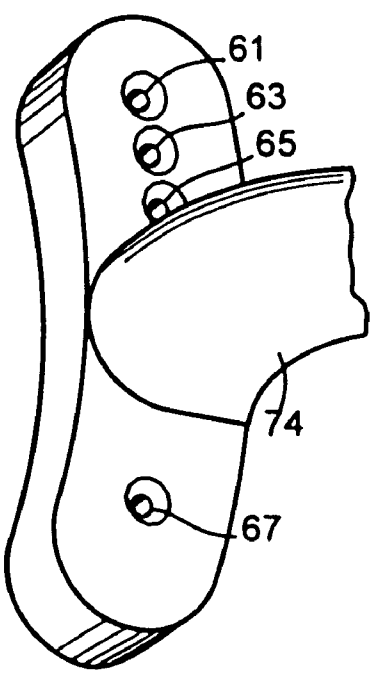

Likewise, for the alternate embodiment seen in FIG. 4*b*, one of holes 61, 63, or 65 may be employed with hole 67 to fasten attachment mount 71 to a mounting ring mounting surface. This allows connection of attachment mount 71 to mounting rings having three differently spaced mounting fastener hole configurations.

Figure 4C:
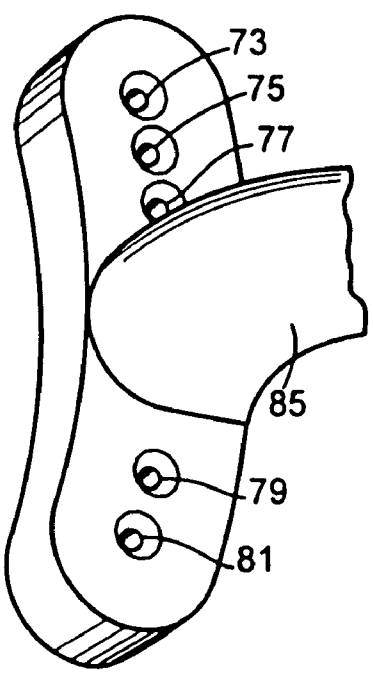

FIG. 4*c* shows attachment mount 85. It may be attached by using either of holes 73, 75, or 77 in tandem with one of holes 79 or 81 for fastening to as many as six different mounting ring mounting surfaces, each having a different mounting fastener hole configuration.

Figure 4D:
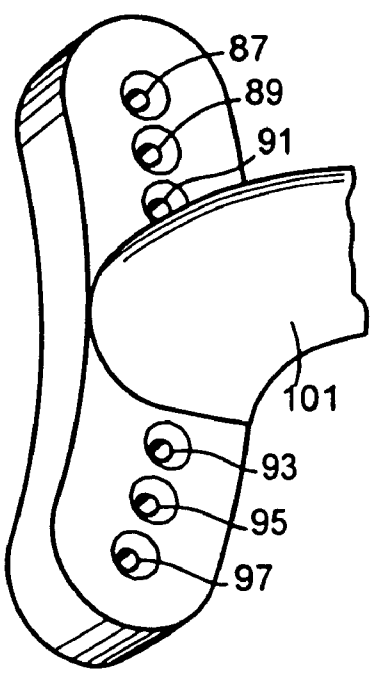

Finally and in the same manner, FIG. 4*d* illustrates attachment mount 101 having holes 87, 89, 91, 93, 95, 97. As with the embodiments shown in FIGS. 4*a–c*, attachment mount 101 is employed by using one of holes 87, 89, or 91 as well as one of holes 93, 95, or 97. Such use enables attachment to up to nine different mounting surfaces.

As seen in FIGS. 4*b–d*, holes 61, 63, 65; holes 73, 75, 77; holes 87, 89, 91; and holes 93, 95, 97 are linearly disposed. These holes are tangent to one another and, in fact, overlap one another. As such, these sets of holes are linearly disposed and adjacently overlapping. For example, just as in FIGS. 4*b* and 4*c*, holes 87, 89, and 91 seen in FIG. 4*d* exist in a linear fashion. Hole 87 is tangent to hole 89 and hole 89 is tangent to both holes 87 and 91. Hole 91 is tangent to hole 89. As such, fastening screws used to attach attachment mounts having holes that are linearly disposed and adjacently overlapping cannot slide from one of the holes into another of the adjacent overlapping holes.

Holes 51 and 53 in FIG. 4*a* are also linearly disposed. Nonetheless, holes 51, 53 in FIG. 4*a* are separated by a space 52. This space 52 is formed of the metallic, solid structure of base 58.

As seen in FIG. 5, an alternate embodiment of the present invention is an attachment mount 201 having an elongated member 203, and a kidney/disc-shaped base 205 that has ends 207, 209, respectively. Attachment mount 201 also has channel 211 on end 207 and channel 213 on end 209. These channels 211, 213 have inner side walls 215, 217 respectively. They also have respective concentric lips 219, 221.

Plates 223 and 225 fit snugly into respective channels 211, 213, against respective concentric lips 219, 221, and within respective inner walls 215 and 213. Plates 223, 225 have holes 227, 229, 231 through which fastening screws 233, 235 thread. This allows fastening of attachment mount 201 to a ceiling fan rotor mounting ring (not shown) having a mounting surface with a specified mounting hole configuration. As seen in FIG. 5, screw 233 can be used to fit one of two mounting surfaces when using plate 223 with plate 225. This is accomplished by choosing either holes 227 or 229 depending on the distance of mounting screw holes in a particular mounting screw hole configuration.

As seen in FIGS. 6*a–d*, the attachment mount 201 seen in FIG. 5 may be used on a multitude of ceiling fan mounting surfaces. FIG. 6*a* illustrates a plate 251 having two holes 253 and 255. FIG. 6*b* shows a plate 257 having a hole 259. Hole 259 is positioned differently in either of holes 253 or 255 found on plate 251. Likewise, hole 263 in FIG. 6*c* is positioned relative to plate 261 than either holes 253, 255, or 259. Finally, as seen in FIG. 6*d*, hole 267 which is placed at the end of plate 265 provides an additional position through which screws 235 or 233 can fit to attach attachment mount 201 to the mounting surface of a fan blade mounting ring. It should be noted that the plates illustrated in FIGS. 6*a–d* are merely exemplary of the large number of hole positions available in mounting plates in accordance with the present invention.

Attachment mounts in accordance with the present invention are preferably made from brass, but may be made from any suitably rigid and reinforced metal or plastic in compliance with government safety standards and the rigors of day-to-day fan use.

The invention has been described in terms of screws as the conventional method of attachment. Alternative fasteners including bolts, Dzus fasteners, expansion bolts, rivets, etc. may be used.

Figure 7A:
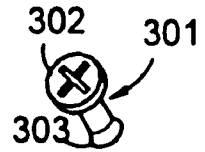
FIGS. 7*a*, 7*b*, and 7*c* are views of decorative inserts useable with the attachments disclosed.
Figure 7B:
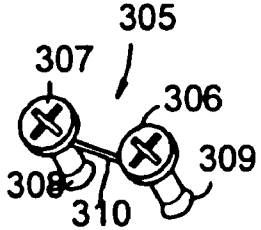
Figure 7C:
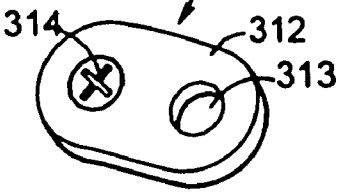

The desirability and hence the ultimate utility of the attachment mounts of this invention lies in having the appearance of original equipment. FIGS. 7*a*, 7*b* and 7*c* show components which serve to disguise the universal nature of this adaptor. FIG. 7*a* is a plug 301 for insertion into an unused hole such as two of holes 18, 19, 23 and 24 of FIG. 3.

The plug has a head 302 with a finish pattern identical to that used in the screw used to hold the adaptor to the mounting ring. Splayed end 303 extends to a depth slightly greater than the depth of the adaptor and holds the plug in place in the blind hole. FIG. 7*b* shows a double plug 305 with a pair of spaced heads 306,307, each attached to splayed ends 308, 309, the arrangement being held together by bridge plate 310.

For the embodiment shown in FIG. 5, the device 311 having a plate 312 having a hole 313 and a fake fastener 314 may be used. Preferably, the plate is reversible, having a head 314 on both sides.

Figure 8A:
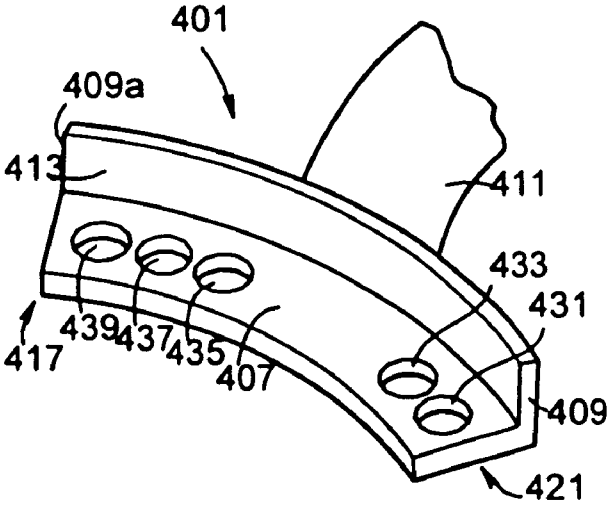
FIGS. 8*a* and 8*b* are perspective and plan views of alternative attachments having a different mounting for the blade support member.
Figure 8B:
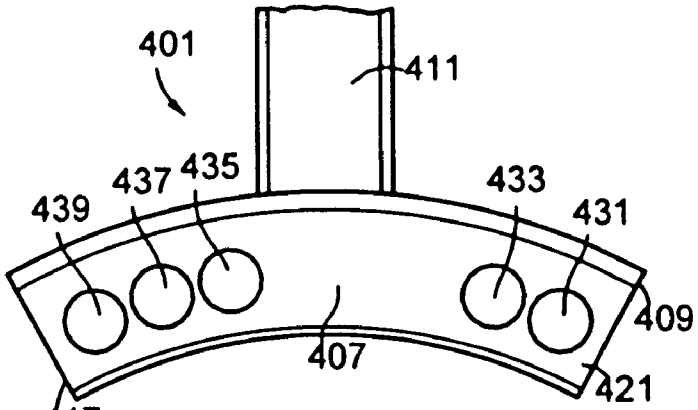

FIGS. 8*a* and 8*b* are variants of the attachment mount shown in FIGS. 4*a, b, c* and *d*. In this embodiment, the attachment 401, having flange surfaces 417 and 421 is a substantially flat sector 407 having formed therein multiple holes 431, 433, 435, 437 and 439. The number and location of the holes depends upon alternative bolting patterns in the mounting ring. The elongated support member 411 is formed to be integral with a lip or step 413 having ends 409, 409*a*. The flat surface 409 allows the holes to be positioned where support member 411 would otherwise be attached, thus enabling greater universality of application.

It should be noted that the present invention is useful for, and may be adapted to fit any extension of a ceiling fan rotor having a surface for receiving a fan blade attachment mount. Moreover, receiving points as defined herein, shall include not only mounting screw holes, but other female-type connections, male-type connections, tabs, clips, pins and various and assorted other connection mechanisms.

In addition, an alternative embodiment has one or more connectors such as a tab, locking pin or other structure instead of the holes in the flange portions. Such structures should provide requisite stability for the needed fan blade attachment.

Although the present invention has been described in considerable detail with reference to certain preferred versions thereof, other versions are possible. For example, the materials of the apparatus may be metal or rigid high-strength plastic or composite materials. The metal or coated finish on the exterior of any portion of the attachment mount, including but not limited to, the elongated support member 11, the base 16 (or flange) and the plates may be of any color or texture. Likewise, the distal end 13 as well as any portion or the whole of the attachment mounting 9 may take on a multitude of decorative and/or ornamental shapes and/or features. In addition to screws, other fastening means, including connectors, pins, rivets, bolts and the like, may be utilized. As mentioned, holes need not be present, as a wide assortment of connectors comprising various structures, and fastening means may be used in tandem or alone.

In accordance with the present invention, the above described embodiments each provide an apparatus for connecting ceiling fan blades to variety of ceiling fan rotor extension mounting surfaces. Each is an attachment mount having an elongated support member adapted to connect to a fan blade at its distal end and a variety of fan rotor extensions at its proximal end.

It is thus seen that the apparatus of the present invention meets the objectives and advantages herein set forth. It allows attachment of ceiling fan blades to the base of a wide variety of ceiling fan mounting rings having various diameters and/or attachment point positions, that has increased stability. It alleviates undue stresses imposed thereon to provide a more durable and thus safer, fan blade mounting. The present invention also provides a fan blade mounting that is simple in design, light-weight, sturdy and easy-to-install. Many variations will undoubtedly become apparent to one.

What is claimed is:

1. A fan blade attachment mount for supporting and connecting a ceiling fan blade to various fan blade mounting rings having mounting surfaces and distinct receiving point configurations, comprising:

an elongated support member having a proximal end adapted to connect to a ceiling fan mounting ring, and a distal end adapted to connect to the fan blade;

a first flange portion connected to said proximal end and having at least one hole;

a second flange portion connected to said proximal end and having more than one hole, each adapted to receive a fastening means;

wherein said attachment mount is adapted to being fastened to the plurality of mounting rings having varying said mounting receiving point configurations, according to which of said more than one hole operably received said fastening means for connection to said mounting surface; and wherein said more than one hole are linearly disposed and adjacently overlap each other, and wherein said fastening means cannot slide from one of said more than one hole into another of said more than one hole.

2. The fan blade attachment mount according to claim 1 wherein said more than one hole are three holes and said at least one hole is one circular hole.

3. The fan blade attachment mount according to claim 1 wherein said more than one hole are three holes and said at least one hole is two overlapping holes.

4. The fan blade attachment mount according to claim 1 wherein said more than one hole are three holes and said at least one hole is three linearly disposed, adjacently overlapping holes.

5. A fan blade attachment mount for supporting and connecting a ceiling fan blade to various fan blade mounting rings having mounting surfaces and distinct receiving point configurations, comprising:

an elongated support member having a proximal end adapted to connect to a ceiling fan mounting ring, and a distal end adapted to connect to the fan blade;

a first flange portion connected to said proximal end and having at least one hole;

a second flange portion connected to said proximal end and having more than one hole, each adapted to receive a fastening means;

wherein said attachment mount is adapted to being fastened to the plurality of mounting rings having varying said mounting receiving point configurations, according to which of said more than one hole operably received said fastening means for connection to said mounting surface; and wherein said first flange portion further comprises a channel having a concentric lip, wherein said at least one hole is defined by a plate wherein said plate is operably inserted into said channel against said lip.

6. The fan blade attachment mount according to claim 5 wherein said second flange portion further comprises a channel having a concentric lip, wherein said one or more holes are defined by a plate having at least one hole, and wherein said plate is operably inserted into said channel of said second flange against said lip of said second flange.

* * * * *